US006753755B2

(12) United States Patent
Montague

(10) Patent No.: US 6,753,755 B2
(45) Date of Patent: Jun. 22, 2004

(54) ELECTRICAL SAFETY CONNECTOR FUSE

(75) Inventor: William A. Montague, Concord, MA (US)

(73) Assignee: Safer Home, Inc., Concord, MA (US)

( * ) Notice: Subject to any disclaimer, the term of this patent is extended or adjusted under 35 U.S.C. 154(b) by 7 days.

(21) Appl. No.: 10/086,749

(22) Filed: Feb. 28, 2002

(65) Prior Publication Data

US 2003/0001715 A1 Jan. 2, 2003

Related U.S. Application Data

(60) Provisional application No. 60/301,693, filed on Jun. 28, 2001.

(51) Int. Cl.[7] ..... H01H 85/044; H01H 85/165; H01H 85/30

(52) U.S. Cl. ..... 337/265; 337/255; 337/187; 337/206; 337/268; 337/269; 361/105

(58) Field of Search ..... 337/198, 158, 337/186, 187, 206, 255, 265, 266, 268, 269; 361/103, 105, 118, 119; 307/86; 340/652, 656; 439/621, 622

(56) References Cited

U.S. PATENT DOCUMENTS

| | | | | | |
|---|---|---|---|---|---|
| 2,226,148 | A | * | 12/1940 | Taylor | 439/682 |
| 2,597,600 | A | * | 5/1952 | Shapiro | 439/651 |
| 3,218,413 | A | | 11/1965 | Koch | |
| 3,320,383 | A | | 5/1967 | Koetter | |
| 3,513,435 | A | * | 5/1970 | Degaetano | 439/140 |
| 3,539,961 | A | * | 11/1970 | Worthington | 337/197 |
| 3,710,287 | A | * | 1/1973 | Eckert | 439/693 |
| 3,775,727 | A | * | 11/1973 | Wise | 439/105 |
| 3,924,914 | A | | 12/1975 | Banner | |
| 3,938,068 | A | * | 2/1976 | Hagan | 337/189 |
| 4,071,872 | A | * | 1/1978 | Phillips, Jr. | 361/56 |
| 4,111,516 | A | * | 9/1978 | Wireman | 439/490 |
| 4,178,061 | A | | 12/1979 | Ahroni | |
| 4,275,374 | A | * | 6/1981 | Chaucer | 337/197 |
| 4,484,185 | A | * | 11/1984 | Graves | 340/656 |
| 4,547,827 | A | * | 10/1985 | Shedd | 361/55 |
| 4,575,704 | A | | 3/1986 | Pezold | |
| 4,632,479 | A | * | 12/1986 | Jacobson | 439/145 |
| 4,861,286 | A | * | 8/1989 | Fosnaugh | 439/651 |
| 4,897,049 | A | * | 1/1990 | Miller et al. | 439/365 |
| 4,934,962 | A | * | 6/1990 | Luu et al. | 439/651 |
| 5,004,435 | A | * | 4/1991 | Jammet | 439/652 |
| 5,137,473 | A | | 8/1992 | Nickola | |
| 5,383,799 | A | * | 1/1995 | Fladung | 439/652 |
| 5,451,173 | A | * | 9/1995 | Mai | 439/622 |
| 5,590,010 | A | * | 12/1996 | Ceola et al. | 361/93.4 |
| 5,641,311 | A | * | 6/1997 | Chuang | 439/693 |
| 5,897,398 | A | * | 4/1999 | Maeda | 439/693 |
| 6,109,977 | A | * | 8/2000 | Baxter et al. | 439/693 |

FOREIGN PATENT DOCUMENTS

| | | | | |
|---|---|---|---|---|
| GB | 2220188 A | * | 1/1990 | G09G/3/06 |
| GB | 2356621 A | * | 5/2001 | G09F/3/10 |
| GB | 2373377 A | * | 9/2002 | H01R/13/46 |

* cited by examiner

*Primary Examiner*—Anatoly Vortman
(74) *Attorney, Agent, or Firm*—Francis J. Caufield

(57) ABSTRACT

An electrical safety connector fuse for insertion into a two- or three-pin electrical socket comprises a sealed, tamper-proof housing having live and neutral apertures, and live and neutral receptacles for receiving the prongs of a plug, live and neutral prongs for insertion into the socket, and a fuse disposed within the housing. The connector fuse desirably has an internal light which lights up when the fuse is connected to a live socket, a blocking member or gate to prevent a user from receiving an electric shock by inserting objects into the live aperture of the fuse, and an insulting coating on at least a part of the live prong to prevent electric shocks as the fuse is inserted into a socket.

26 Claims, 13 Drawing Sheets

3/13

ELECTRICAL SAFETY CONNECTOR FUSE

CROSS-REFERENCE TO RELATED APPLICATION

This application claims priority from copending Provisional Patent Application No. 60/301,693, filed Jun. 28, 2001; the entire disclosure of which is incorporated herein by reference.

FIELD OF THE INVENTION

This invention relates generally to electrical fuses, and more specifically, to an electrical safety connector fuse having a plug intended for insertion into an outlet or socket of a domestic or similar electrical system, the connector fuse being intended to receive a plug to provide additional safety.

BACKGROUND OF THE INVENTION

Conventional electrical systems used to provide electrical power (e.g. 110/220 V in US) in residences and other buildings use circuit breakers to provide protection against short circuits or similar malfunctions in the electrical system itself or in equipment attached thereto. Typically, a single set of wires enters a residence and is connected to a circuit breaker box containing a plurality of circuit breakers, each of which is connected to one of a plurality of electrical circuits which radiate out from the box. Each of these circuits supplies power to several different wall outlets, light fittings or other electrical devices. One or more or the circuit breakers within the box may be of the ground fault interrupter type to provide additional safety to outlets in bathrooms or outside the house, where they may be exposed to water.

Although circuit breakers are effective in preventing damage from many electrical malfunctions, they suffer from several problems. Firstly, the circuit breakers themselves are mechanical devices which may fail to open when a current greater than their rated load passes through them. Such failures may be caused, for example, by corrosion or accumulation of dirt and debris within the circuit breaker, especially since circuit breakers in private houses are rarely if ever inspected by professional electricians. Secondly, although the rating of a circuit breaker can be varied for the intended use of the circuit connected thereto, each circuit breaker typically controls several electrical outlets. Therefore, the circuit breaker may not be specific to each outlet or appliance, but instead supplies to the circuit as a whole. For example, a single outlet in a kitchen might be used to power both an under-cabinet fluorescent lamp, drawing less than 20 W, and an electric kettle, drawing 1500 W. A malfunction in the lamp which caused it to draw 500 W might well be dangerous, but would not trip the associated circuit breaker, which must be able to pass the 1500 W required by the kettle. Finally, circuit breakers, being mechanical devices, may not respond quickly enough to prevent an accidental electrocution.

In addition to the hazards of electrocution, there is the ever present danger of fires caused by overloaded circuits and/or shorting failures in appliances attached to circuits.

For the foregoing reasons, many experts believe that fuses placed adjacent each appliance provide better safety protection than centrally located circuit breakers, and personal computers and other expensive consumer electronics are often sold with internal fuses. However, such fuses give rise to additional problems. Laymen may well be unaware that such fuses are present, and there is no indication on the exterior of the electronic device when the fuse has blown; the electronic device simply stops working. Also, even if the owner of the device discovers the blown fuse, the fuses are not well standardized, so there may be difficulty and delay in procuring a replacement fuse.

In view of these known disadvantages of both circuit breakers and internal fuses, so-called "fused connectors" have been developed. Such fused connectors are described for example in U.S. Pat. No. 3,218,413 (Koch); U.S. Pat. No. 3,320,383 (Koetter); U.S. Pat. No. 3.924,914 (Banner); U.S. Pat. No. 4,178,061 (Ahroni); U.S. Pat. No. 4,575,704 (Pezold); and U.S. Pat. No. 5,137,473 (Nickola). Essentally, a fused connector comprises a conventional plug adapted to plug into an electrical socket and is provided with a socket into which the plug of an appliance is inserted. A fuse is connected between the prongs of the connector fuse and the socket so that if the appliance draws too much power the fuse will blow. The rating of the fuse can be varied depending upon the type of appliance with which the connector fuse is intended to be used. The aforementioned Banner patent suggests that a small lamp be connected between the live and neutral lines with the fused connector such that the light will be lit when the connector is inserted into an electrical socket but will go out when the fuse blows, thus providing a visual indicator of a blown fuse.

Known fused connectors suffer from several disadvantages. The fuse is accessible to users so that it is possible for a user to replace the original fuse with one having a different rating. Consequently, there is usually no visual indication of the rating of the fuse within the connector, which renders it difficult for the user to select a connector having a fuse rating appropriate for the particular appliance with which it is to be used. Also, when the connector is inserted into a socket, there is nothing to prevent a child from (or perhaps an incautious adult wielding a screwdriver) inserting a narrow metal object into the live receptacle intended to receive the live prong of a plug, and the child may receive a dangerous, and perhaps even fatal, electric shock before the fuse blows. In addition, some users, when inserting the fused connector into a socket, tend to hold it by the portion adjacent the prongs, and it is easy for the user's fingers to contact the live prong as it is being inserted into the socket, thus giving the user an electric shock. Finally, many fused connectors fail to provide any visual indication that a fuse has blown.

Consequently, it is a primary object of the present invention to provide an electrical safety connector which overcomes these disadvantages of prior art fused connector.

It is a further object of the present invention to provide a safety connector fuse which can provide a reliable indication of the rating of the fuse therein.

It is a further object of the present invention to provide a safety connector fuse which can provide a reliable indication when its fuse has blown.

It is a further object of the present invention to provide a safety connector fuse which renders it difficult for a user to suffer an electric shock by insertion of an object into the apertures intended to receive the plug of an electrical appliance.

It is a further object of the present invention to provide a safety connector fuse which renders it difficult for a user to suffer an electric shock as the safety connector fuse is being inserted into a socket.

Other objects of the invention will be apparent and will appear hereinafter in the following detailed description when read in connection with the drawings.

SUMMARY OF THE INVENTION

This invention provides an electrical safety connector fuse for insertion into a standard electrical socket having at least live and neutral prong receptacles. The safety connector fuse comprises a sealed, tamper-proof housing having live and neutral apertures arranged to receive the live and neutral prongs, respectively, of an electrical plug. The connector fuse further comprises live and neutral prongs extending outwardly from the housing at points spaced from the live and neutral apertures, the live and neutral prongs being arranged to engage the live and neutral prong receptacles, respectively, of an electrical socket, or the like. A fuse is disposed within the housing and electrically connected to its live prong. The connector fuse also comprises a live receptacle electrically connected to the fuse, and disposed within the housing adjacent the live aperture therein so as to engage the live prong of a plug passing through the live aperture, and a neutral receptacle electrically connected to the neutral prong, and disposed within the housing adjacent the neutral aperture therein so as to engage the neutral prong of a plug passing through the neutral aperture.

In the connector fuse of the present invention, at least part of the housing may be light-transmissive, and the connector fuse may be provided with means for emitting light disposed within the housing and adjacent the light-transmissive portion thereof, so that light emitted from the light emitting means is visible outside the housing, the light emitting means being electrically connected to the live and neutral receptacles so as to emit light when a potential difference exists between these receptacles.

Also, the connector fuse in one aspect may comprise a blocking member disposed within the housing adjacent the live and neutral apertures therein, the blocking member having a neutral aperture extending therethrough and being movable between a closed position, in which it blocks the live and neutral apertures in the housing, and an open position, in which the neutral aperture of the blocking member is aligned with the neutral aperture of the housing, thereby allowing the live and neutral prongs of the plug to pass through the live and neutral apertures in the housing and engage the live and neutral receptacles within the housing. The blocking member is provided with biasing means for continuously biasing the blocking member towards its closed position. The blocking member also has a cam surface disposed adjacent its neutral aperture and arranged to be engaged by the neutral prong of the plug passing through the neutral aperture in the housing, so that contact between the neutral prong and the cam surface causes the blocking member to move to its open position under the force applied by the bias spring. The blocking member may be provided with a recess arranged so that, when the blocking member is in its closed position, the recess will lie adjacent the live aperture of the connector fuse, so that a portion of the live prong of a plug can be accommodated within the recess while the blocking member is still in its closed position.

Also, the neutral prong of the connector fuse of the present invention may extend a greater distance from the housing than its live prong.

In another preferred form of the present safety connector fuse, the live prong has an outward surface facing away from the neutral prong of the connector fuse, and at least a portion of this outward surface is formed from an electrically insulating material.

For reasons explained in detail below, the usefulness of providing electrically insulating material on the live prong of a plug is not confined to safety connector fuses. Thus, in another aspect, this invention provides an electrical plug having a housing and live and neutral prongs extending therefrom, the live prong having an outward surface facing away from the neutral prong, and at least a portion of this outward surface being formed from an electrically insulating material.

The connector fuse of the present invention provides several safety features. The sealed, tamper-proof housing prevents user replacement of the fuse so that a user can be confident that any markings on the plug accurately indicate the rating of the fuse contained therein, thus assuring that the user can select an appropriately rated connector fuse for a particular appliance. The extra length of the neutral prong of the plug (when present) as compared with its live prong, ensures that the neutral prong will make contact with the neutral receptacle of the socket before the live prong of the plug makes contact with the live receptacle, so that the live receptacle of the connector fuse cannot go live before an appropriate connection has been made with the neutral line. The blocking member ensures that a user cannot receive an electric shock by inserting a narrow metal object into the live aperture in the connector fuse. The provision of electrically insulating material on the outward surface of the live prong helps to ensure that a user will not receive an electric shock by-accidentally touching electrically conductive material in the live prong of the connector fuse as the fuse, or similarly equipped plug, is being inserted into a socket, as it is being pulled out of a socket, or is only partway in a socket.

BRIEF DESCRIPTION OF THE DRAWINGS

The structure and operation of the safety connector fuse of the present invention, together with other objects and advantages thereof, may best be understood by reading the detailed description which follows in connection with the drawings, in which unique reference numerals have been used throughout for each part and wherein.

DETAILED DESCRIPTION OF THE INVENTION

Figure 1:
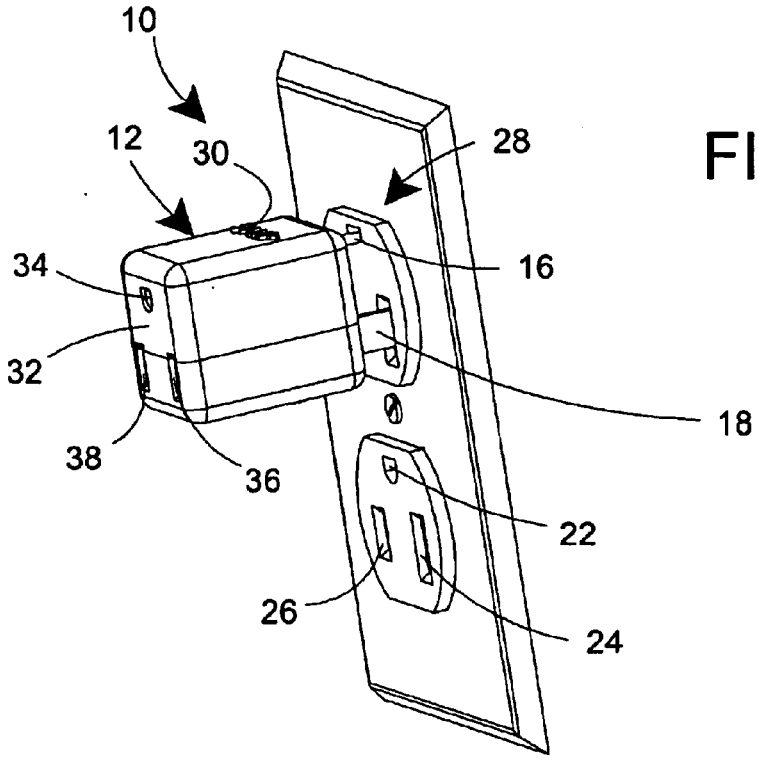
FIG. 1 is a diagrammatic perspective three-quarter view, from above and to one side, showing a three-pin safety connector fuse of the present invention being inserted into a standard three-pin electrical socket.
Figure 3:
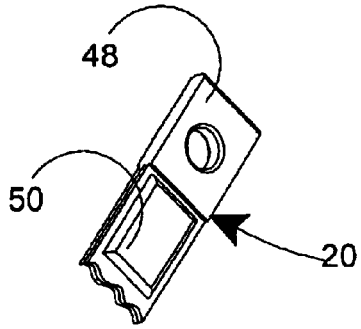
FIG. 3 is an enlarged view of a portion of the live prong of the connector fuse shown in FIG. 1.
Figure 5:
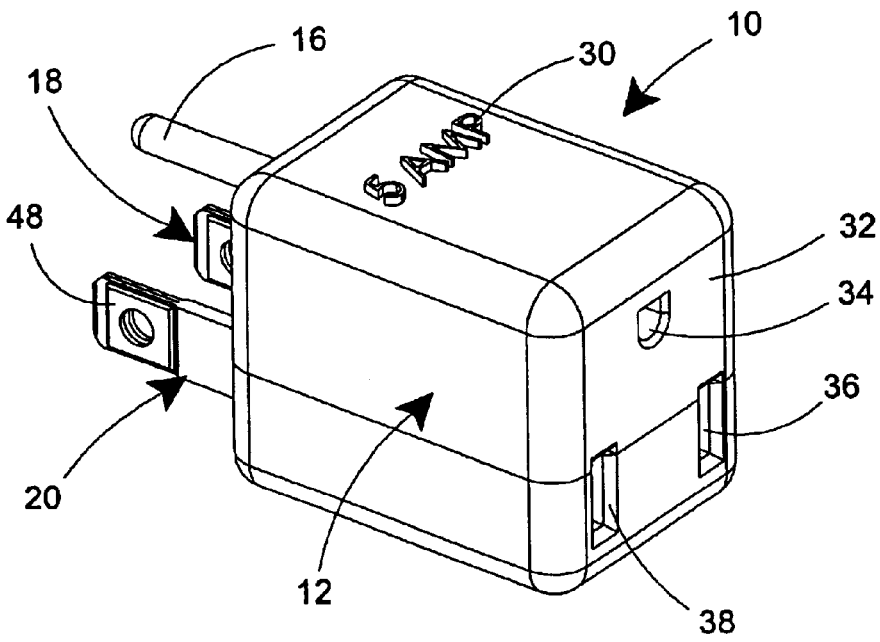
FIG. 5 is an enlarged diagrammatic perspective three-quarter view of the three-pin safety connector fuse shown in FIGS. 1 and 3.

The three-pin fused safety connector fuse of the present invention is shown in FIGS. 1, 3 and 5 where it is generally designated as 10 and comprises a substantially cuboidal sealed, tamper-proof housing 12 formed of transparent plastic. The housing 12 has a flat front face 14 (see FIG. 9) from which project a ground prong 16, a neutral prong 18 and a live prong 20 (FIG. 3) arranged to engage the ground, neutral and live apertures 22, 24 and 26, respectively, of a conventional three-pin electrical socket (generally designated 28).

The housing 12 has markings 30 on its upper and lower surfaces (see especially FIGS. 8 and 9) indicating the rating of the fuse (see below) contained within the housing. It is desirable that the markings be repeated in Braille so that the rating of the connector fuse 10 can for used by the visually impaired.

Figure 4A:
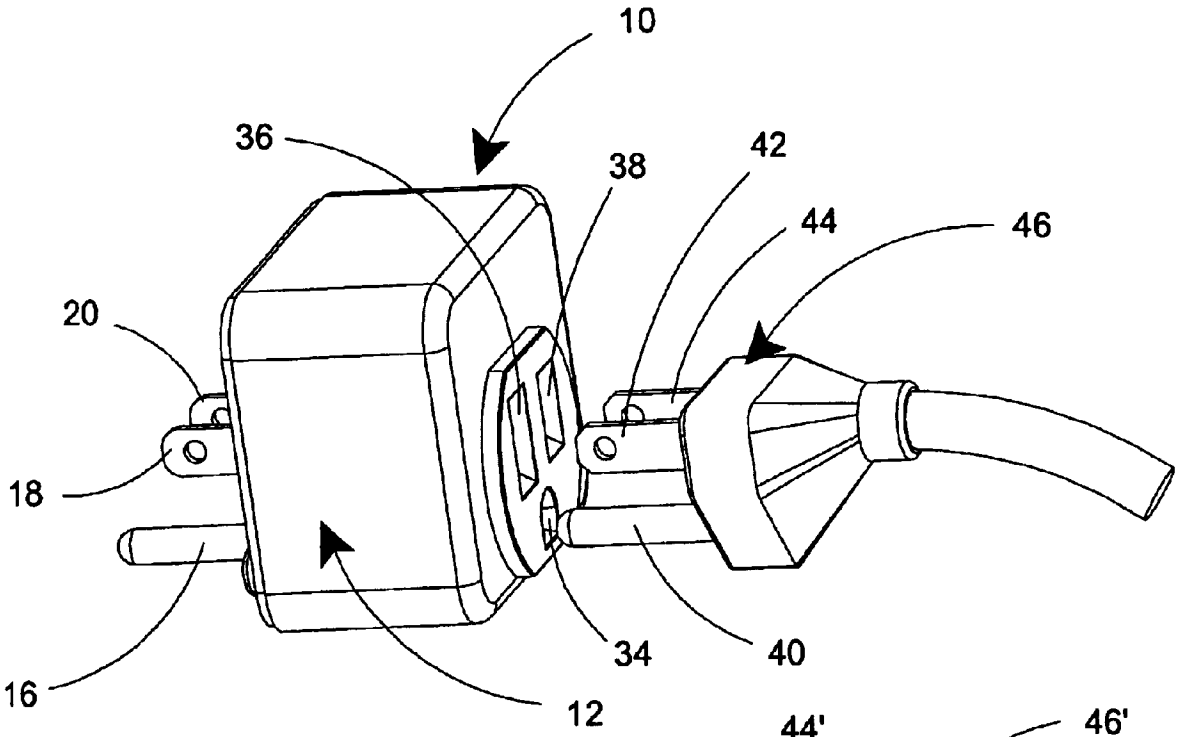
FIG. 4A is a diagrammatic perspective three-quarter view, from above and to one side, showing a standard three-pin plug being inserted into the safety connector fuse shown in FIG. 1.
Figure 4B:
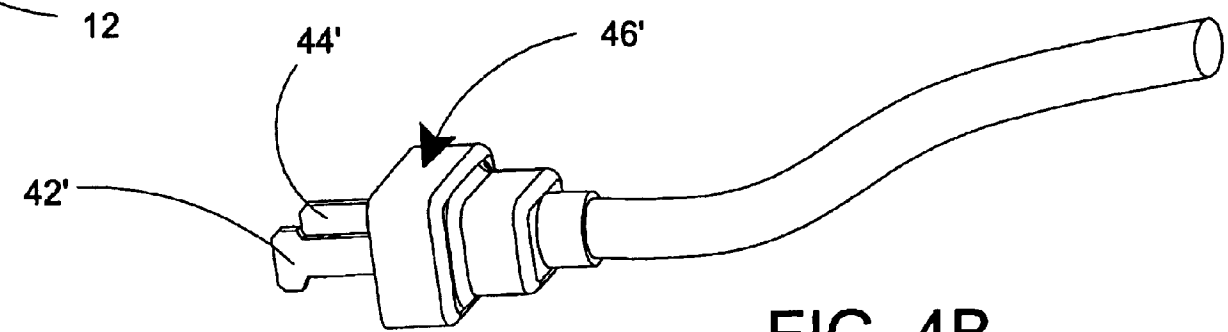
FIG. 4B is a diagrammatic perspective three-quarter view, similar to that of FIG. 4A, but showing a standard polarized two-pin plug which may be used with the safety connector fuse shown in FIG. 1 in place of the three-pin plug shown in FIG. 4A.

On its rear surface 32, the housing 12 is provided with ground, neutral and live apertures 34, 36 and 38, respectively, generally similar to the apertures 22, 24 and 26 in the socket 28, and arranged to receive the ground, neutral and live prongs, 40, 42 and 44 respectively of the plug 46 of an electrical appliance (see FIG. 4A). Although primarily designed for use with a three-pin plug, such as the plug 46, the safety connector fuse 10 can, of course, accommodate a two-pin plug, such as the polarized two pin plug 46' shown in FIG. 4B. Polarized two pin plug 46' has a neutral is prong 42' and a live prong 44'.

As best seen in FIGS. 3 and 5, each of the neutral and live prongs, 18 and 20, respectively, of the connector fuse 10 has essentially the same form as the prongs of a conventional plug, namely that of elongate flat plates having two major surfaces, an inward surface which faces towards the other prong, and an outward surface which faces away from its opposing prong. A tip portion of each prong, remote from the housing 10, bears an electrically non-conducting, preferably, polymeric coating 48, which extends over both the inward and outward surfaces of the prong; conveniently, the coating 48 may be formed by injection molding around the metal tip of the prong. A root section of each prong, adjacent the housing, is formed from a conductive metal. As best seen in FIG. 3, the inward and outward surfaces of these root section are provided with portions 50 of increased thickness so that their surfaces are coplanar with the surfaces of the polymeric coatings 48 so order that the inward and outward surfaces of the prongs, 18 and 20, are substantially flat. This helps to ensure that the prongs 18 and 20 can be smoothly inserted into and removed from an electrical socket without any tendency for the prongs to "catch" at the junction between the basal and tip portions thereof.

Those skilled in the relevant art will recognize that other approaches may be taken to provide the required insulating properties for the prongs, 18 and 20. For example, Teflon coatings may be applied in required thickness, shrink tubing may be used, or the surfaces may be treated to render them non-conducting where the material composition of the prongs permits it as, for example, by anodizing aluminum.

Figure 2:
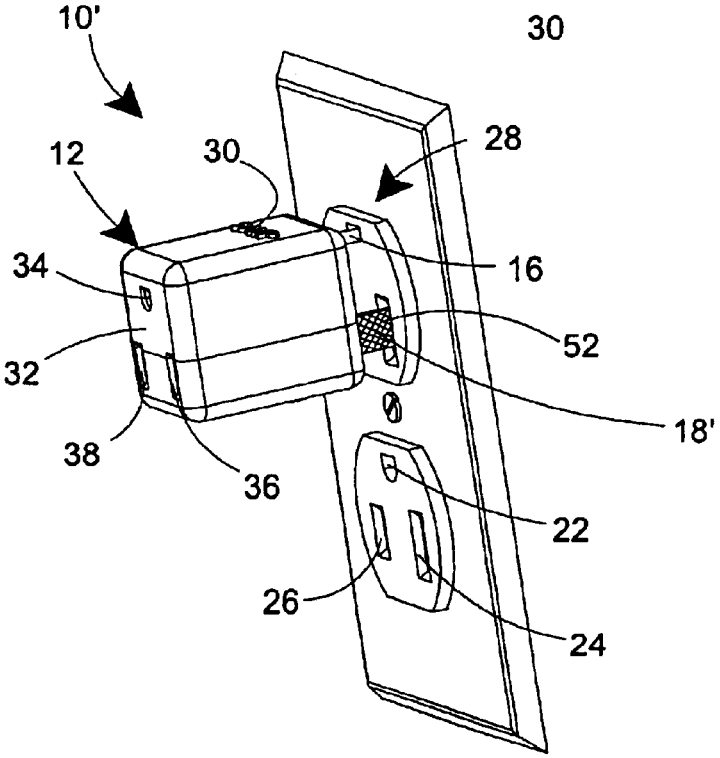
FIG. 2 is a diagrammatic perspective three-quarter view similar to that of FIG. 1, but showing a modified three-pin connector fuse of the present invention being inserted into a standard three-pin electrical socket.

FIG. 2 shows a modified safety connector fuse 10' which differs from the connector fuse 10 shown in FIGS. 1, 3 and 5 in the arrangement of insulating material on the prongs. In safety connector fuse 10', a root section of the outward surfaces of the neutral prong 18' and the live prong (not visible in FIG. 2) is coated with an electrically insulating material 52, the inner surface being left uncoated.

The insulating coatings 48 and 52 are designed to prevent accidental electric shocks as the connector fuses 10 and 10' are inserted into electrical sockets. Many people, when inserting a connector fuse into a socket, hold it by the portion of the housing 12 adjacent the prongs, and it is not unknown for the fingers of a user to contact the prongs of the connector fuse as the fuse is being inserted into the socket. Unless special provision is made, the live prong 20 of the safety connector fuse 10 becomes live while the front face 14 is still some distance from the surface of the socket, and between this point and the point at which the front face 14 of the connector fuse approaches so closely to the surface of the socket that a finger can no longer be inserted between the two, any contact between a finger of the user and the live prong 20 of the connector fuse will cause the user to receive an electric shock. This potential for electric shock is especially great for blind and visually-impaired people, who may need to locate the socket with their fingertips before inserting the connector fuse, and hence have their fingers close to the prongs of the connector fuse as it is being inserted into the socket.

The purpose of the insulating coatings 48 and 52 is to prevent such electric shocks, though the manner in which this prevention is achieved is somewhat different in the two cases. The insulating coatings 48 on the tips of the prongs 18 and 20 render the tips nonconductive, so that the point at which the live prong 20 becomes live is delayed until the front face 14 of the connector fuse 10 is so close to the socket that a finger cannot be inserted between the two. The insulating coating 52, on the other hand, does not delay the point at which the live prong becomes live, but prevents a finger of a user from contacting a live conducting portion of the live prong.

It will be seen from the foregoing discussion that the insulating coatings 48 and 52 are in principle only required on the live prong of the plug. However, providing these coatings on both the live and neutral prongs involves minimal additional expense and provides an extra measure of security by guarding against the (not uncommon) case where the live and neutral receptacles of the socket are wired the wrong way round so that it is the supposedly neutral prong of the connector fuse which goes live as the connector fuse is inserted into the socket.

It will also be seen from the foregoing discussion that where the insulating coating is provided on the tips of the prongs, as shown in FIG. 3, the coating should cover both the inward and outward surfaces of the prongs in order to delay the point at which the prong goes live. On the other hand, where the insulating coating is provided on a root section of the prongs, as shown in FIG. 2, the coating need only to be provided on the outward surface, since it is almost impossible for a user to touch the inward surface of the prong as the connector fuse is inserted into the socket The insulating coating may cover only the root section of the outward surface, leaving the tip portion of the outward surface uncoated and electrically conductive, or the coating may cover the whole outward surface of the prong; this does not hinder the ability of the prong to make proper electrical contact with the receptacle within the socket since conventional receptacles make electrical contact with both the inward and outward surfaces of a prong (cf. the discussion below regarding contact between the receptacles of the safety connector fuse 10 and the prongs of an appliance plug).

It will readily be appreciated that everything that has been said above about the possibility of a user receiving an electric shock when inserting a connector fuse of the present invention into a socket is equally applicable to insertion of a conventional plug into a socket Accordingly, it is within the scope of the present invention to provide insulating coatings similar to the coatings 48 and 52 discussed above on conventional plugs as well as the safety connector fuses of the invention.

The internal components of the connector fuse 10 shown in FIGS. 1, 3 and 5 will now be described with reference to FIGS. 8, 9 and 12. From FIGS. 8 and 9, it will be seen that the housing 12 is formed from upper and lower sections 12A and 12B, respectively These sections are fixedly secured together by ultra-sonic welding, adhesive, or other suitable means of permanent attachment to form the final tamper-proof housing 12. The ground aperture 34 is formed in the upper section 12A, while the neutral aperture 36 and the live aperture 38 are formed in the lower section 12B, but with small recesses 36A and 38A being formed in the upper section 12A to provide the proper height for the apertures 36 and 38.

Figure 8:
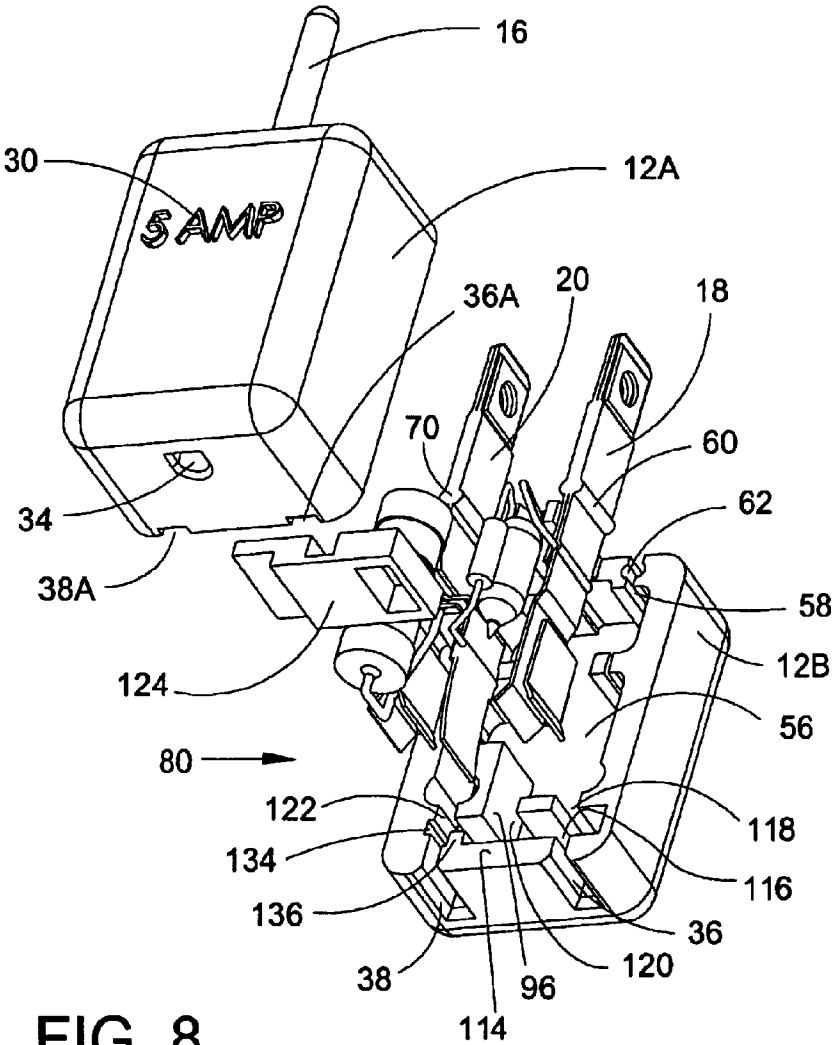
FIG. 8 is an exploded perspective view, from above and to one side, showing the internal components of the three-pin safety connector fuse shown in FIGS. 1, 3 and 5.
Figure 12:
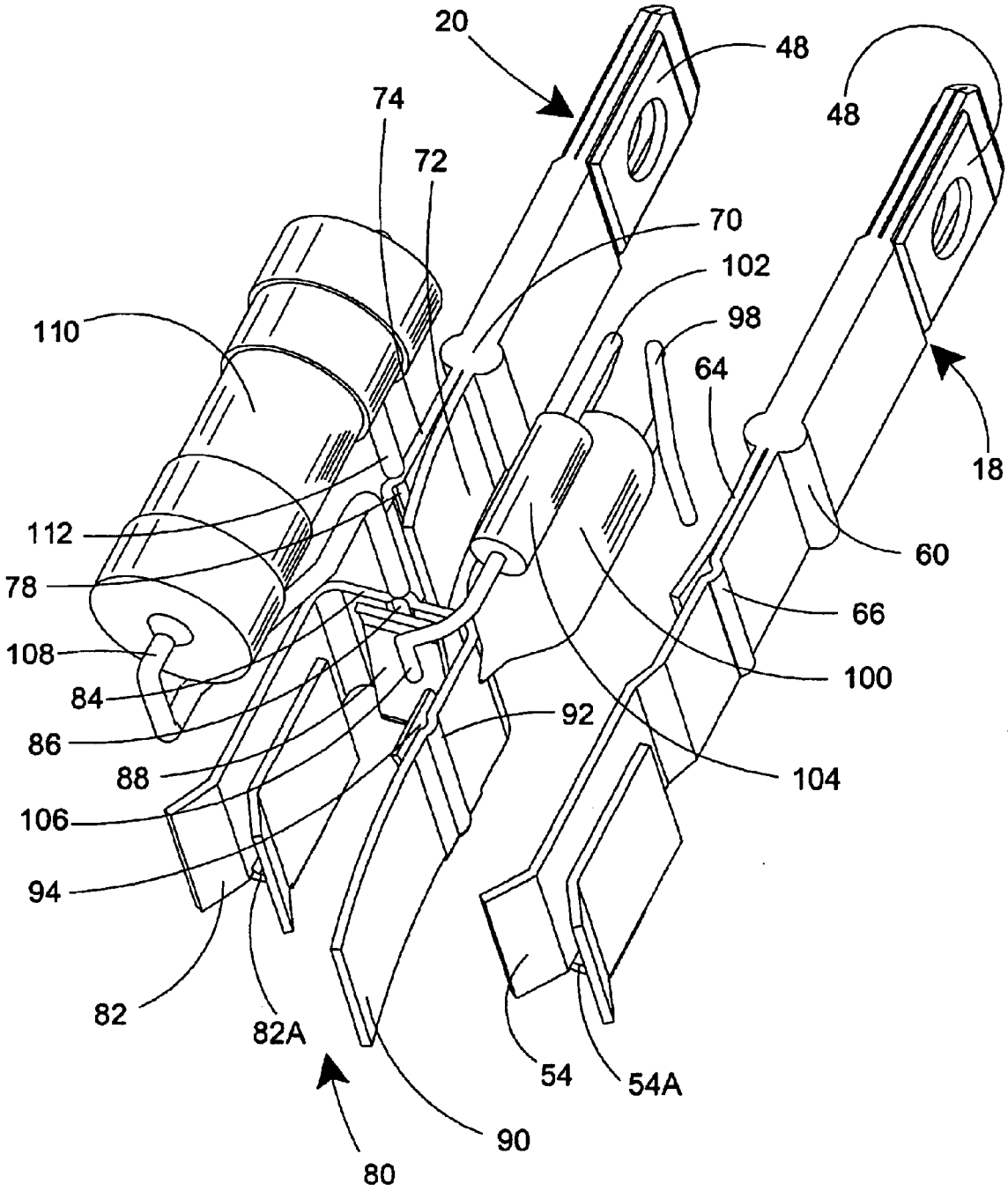
FIG. 12 is an exploded perspective view of certain internal components of the three-pin safety connector fuse shown in FIGS. 1, 3, 5 and 8–11.

FIGS. 8 and 12 also show that the neutral prong 18 is integral with a neutral receptacle 54 comprising a pair of parallel metal leaves joined by a connecting section 54. Receptacle 54 is accommodated within a chamber 56 formed in the lower section 12B of the housing 12. At the point where it passes through a slot 58 in the lower section 12B, the neutral prong 18 is provided with a section 60 of enlarged cross-section, the slot 58 similarly having a complementary configured section 62 of enlarged cross-section, the interaction between the section 60 of the prong 18 and the section 62 of the slot 58 serving to retain the prong 18 in the correct position relative to the housing 12. (When the complete housing 12 is formed by the union of the sections 12A and 12B, the upper face of the slot 58 is of course closed by the adjacent surface of the upper section 12A, thus preventing vertical movement of the neutral prong 18.) The neutral prong 18 is also provided with a side plate 64 which lies parallel and dose to the receptacle 54, the receptacle 54 having a corrugation 66 adjacent the side plate 64.

Similarly, the live prong 20 extends through a slot 68 (FIG. 9) in the lower portion 12B of the housing 12, and the portion of the prong 20 which passes through the slot 68 has a section 70 of enlarged cross-section. Although not visible in the drawings, the slot 68 has essentially the same form as the slot 58, having a section of enlarged cross-section, which accommodates the section 70 of the live prong 20, thus retaining the prong 20 in its correct position relative to the housing 12.

Unlike the neutral prong 18, the live prong 20 is not integral with its associated live receptacle (discussed separately below). Instead the rearward end of the live prong 20 terminates in a side plate 72, of similar form to the side plate 64, and a main section 74 provided with a corrugation 78.

The connector fuse 10 further comprises a live receptacle (generally designated 80) which, as already mentioned, is separate from the live prong 20. The live receptacle 80 has essentially the form of a squared-off "U", having a first limb section 82 which forms the actual live receptacle and which is essentially identical in form to the neutral receptacle 54, comprising two parallel metal leaves joined by a connecting section 82A. The live receptacle 80 also has a base section 84, which is provided with a corrugation 86 and a first auxiliary plate 88 facing this corrugation 86, the auxiliary plate 88 being joined to the base section 84 by a connecting section (not shown) generally similar to the connecting section 82A. Finally, the second limb of the live receptacle 80 is a spring section 90, provided with a corrugation 92 and a second auxiliary plate 94 facing the corrugation 92, the second auxiliary plate 94 being joined to the spring section 90 by a connecting section 94A (FIG. 11) generally similar to the connector 82A. As shown in FIG. 8, the lower section 12B of the housing 12 is molded to provide a block 96 around which the U-shaped live receptacle 80 fits.

Figure 6:
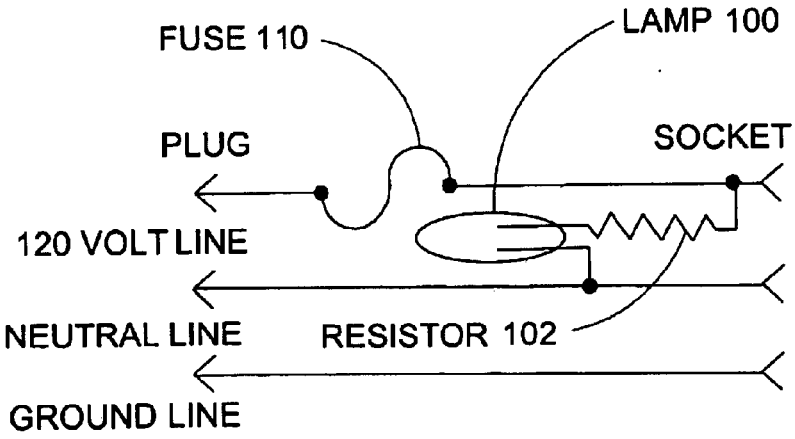
FIG. 6 is a wiring diagram of the three-pin safety connector fuse shown in FIGS. 1, 3 and 5.
Figure 7:
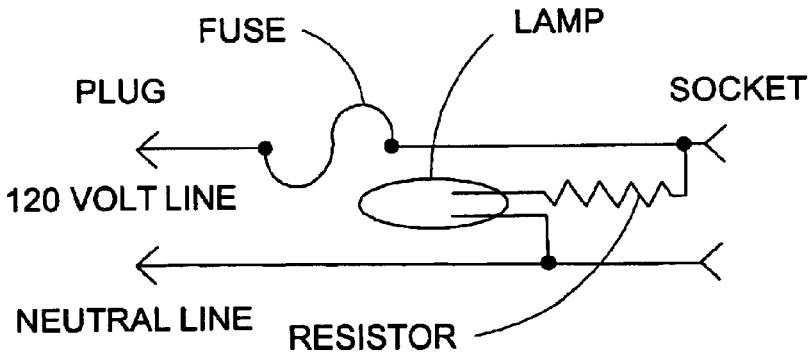
FIG. 7 is a wiring diagram of a corresponding two-pin safety connector fuse.

The various corrugations, side plates and auxiliary plates already mentioned serve to hold electrical connectors associated with a lamp and a fuse of the safety connector fuse 10. More specifically, the side plate 64 and the corrugation 66 clamp between them an electrical conductor 98 leading to a lamp 100. A second conductor 102 leads from the lamp 100 to a resistor 104, from the opposed side of which extends a third conductor 106, the free end of which is clamped between the corrugation 92 and the second auxiliary plate 94. A fourth conductor 108 is clamped between the corrugation 86 and the first auxiliary plate 88 and runs to one terminal of a fuse 110. From the opposed terminal of this fuse 110, a fifth conductor 112 extends downwardly and is clamped between the side plate 72 and the corrugation 78. Thus, the only electrical connection between the live prong 20 and the live receptacle 80 is via the conductors 108 and 112 and the fuse 110. A circuit diagram of the safety connector fuse 10 is provided in FIG. 6. FIG. 7 illustrates how this circuit diagram is modified in a two-pin version of the connector fuse in which the ground prong 16 is omitted.

When the safety connector fuse 10 is inserted into a wall socket or outlet with the fuse intact, the lamp 100 and resistor 104 are connected across the live and neutral lines, and the lamp 100 will light However, if the fuse 110 blows, the lamp will be extinguished or will not turn on, thus providing a visual indication of the blown fuse, since the lamp 100 is visible through the light-transmissive housing 12. The lamp 100 and resistor 104 are accommodated within the chamber 56 provided in the lower section 12B of the housing and an extension 56' (FIG. 9) of this chamber in the upper section 12A. It will be apparent that the fuse and light may be provided as an integrated circuit with the light being in the form of an LED or the like whose color may be used to code the rated value of the fuse.

Figure 9:
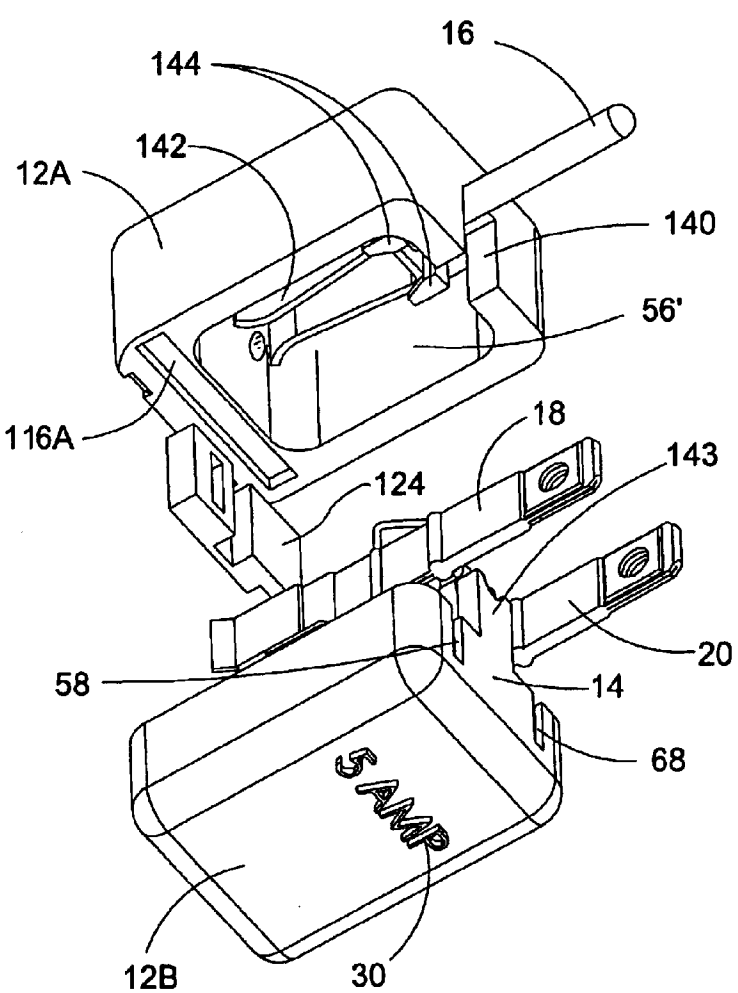
FIG. 9 is a second exploded perspective view showing the internal components of the three-pin safety connector fuse shown in FIGS. 1, 3, 5 and 8, but looking from below and to one side.

As shown in FIGS. 8 and 9, adjacent a rear wall 114, the lower section 12B of the housing is provided with a chamber 116; an extension 116A of this chamber is provided in the upper section 12A so that the chambers 116 and 116A form a single chamber when the complete housing 12 is assembled. The chamber 76 has essentially the form of a flat cuboid, communicating on one side with the neutral and live apertures 36 and 38, respectively, and communicating on the opposed side via slots 118, 120 and 122 with the chamber 56. The neutral aperture 36, the slot 116 and the neutral receptacle 54 are aligned with each other, and the live aperture 38, the slot 122 and the live receptacle 82 are also aligned with each other. The central slot 120 allows the spring section 90 to pass therethrough.

Figure 10:
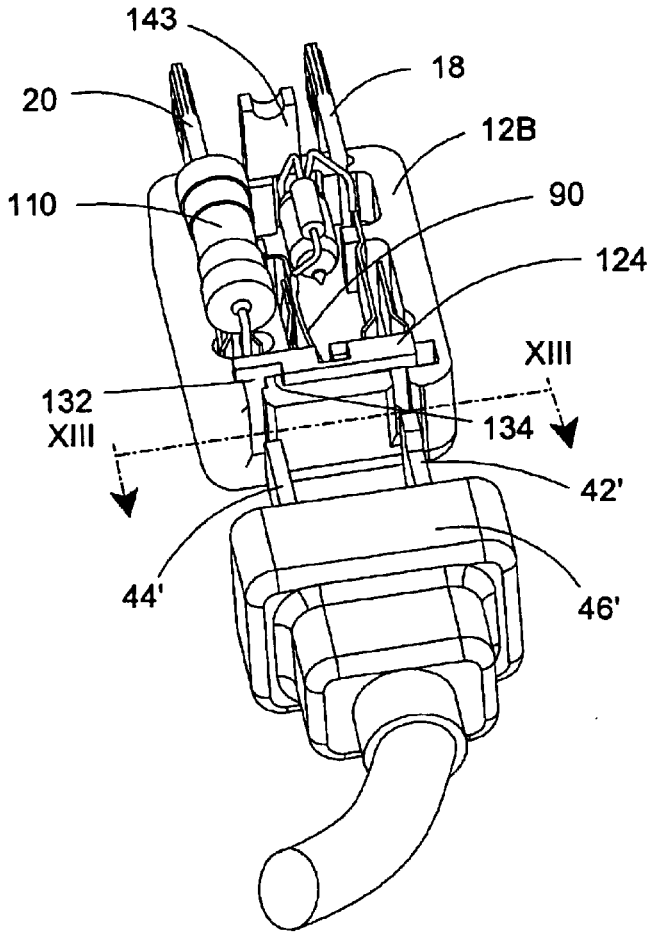
FIG. 10 is a perspective view showing the polarized two-pin plug shown in FIG. 4 being inserted into the three-pin connector fuse shown in FIGS. 1, 3, 5, 8 and 9, with one half of the housing of the connector fuse removed to shown the internal components thereof.
Figure 11:
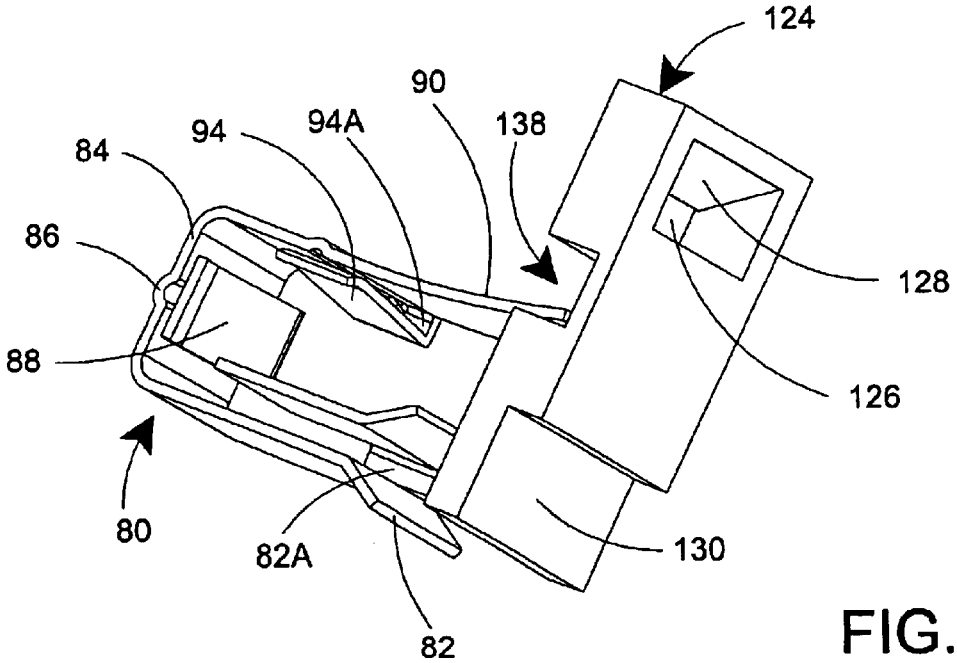
FIG. 11 is a perspective view of the blocking member and associated biasing means of the three-pin connector fuse shown in FIGS. 1, 3, 5 and 8–10.

When the safety connector fuse 10 is inserted into the socket 28 (FIG. 1), a user, absent the safety features to be discussed next, could otherwise insert a metal object through the live aperture 38, the chamber 116 and the slot 118 into the live receptacle 54 and receive an electric shock. To remove this risk of electric shock, a blocking member 124 (which may alternatively be referred as a gate or shutter) is slidably mounted within the chamber 116, this shutter 124 extending into the chamber 116A in the upper section 12A when the complete housing 12 is assembled. As best seen in FIG. 11, the blocking member 124 has substantially the form of a flat, rectangular plate through one end of which passes a neutral aperture 126 large enough to enable the neutral prong 42 of the plug 46 or 46' (FIGS. 4A and 4B respectively) to pass therethrough. Part of the wall of the neutral aperture 126 is inclined at approximately 45° to the thickness of the blocking member 124 to form a cam surface 128. The end of the blocking member 124 remote from the neutral aperture 126 has a section 130 of reduced thickness, thus leaving a recess 132 (FIG. 10) between this section 130 and the inner wall of the rearward portion of the housing 12, this recess 132 extending to a free edge (the left-hand edge in FIGS. 10 and 11) of the blocking member 124. A recess 134 (FIGS. 8 and 13B) is formed in the lower section 12B adjacent this free edge of the blocking member 124, and a projection 136 is provided on the inner surface of the rearward portion of the housing 12, this projection 136 extending into the recess 132.

Figure 13A:
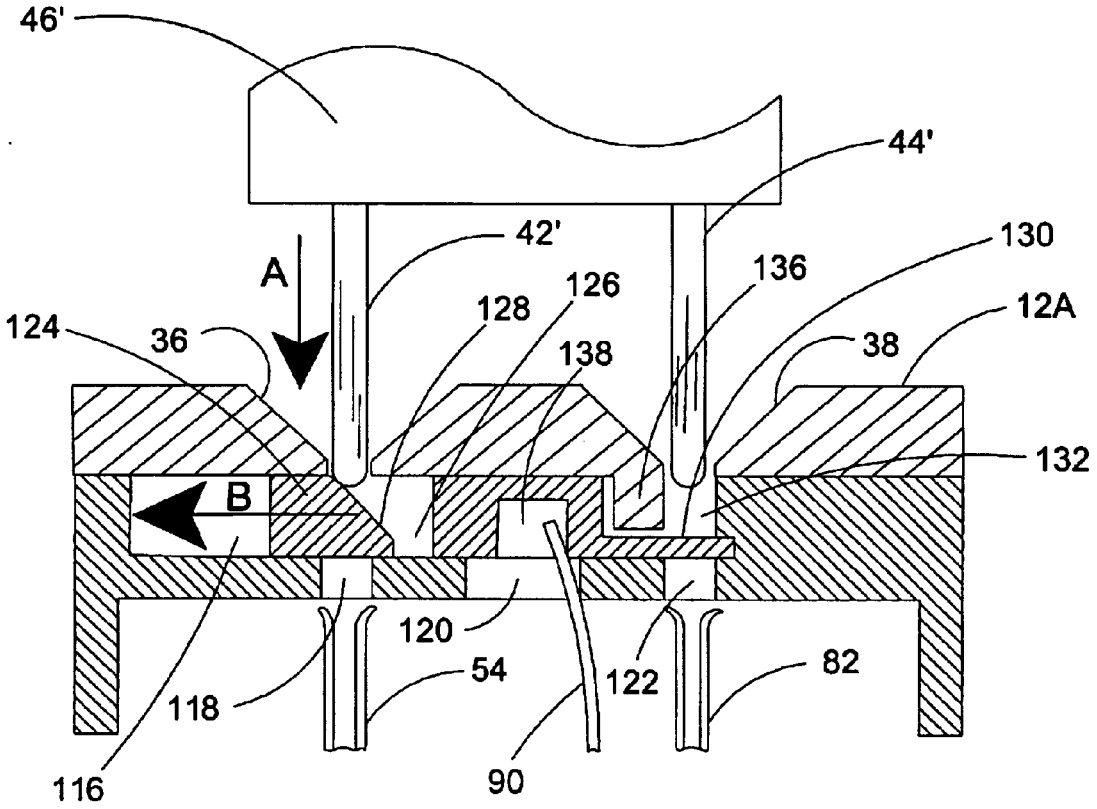
FIGS. 13A and 13B are schematic horizontal sections taken along line XIII—XIII in FIG. 10 showing the manner in which the prongs of a plug inserted into the connector fuse shown in FIGS. 1, 3, 5 and 8–12 cooperate with the blocking member of the connector fuse, FIG. 13A showing the blocking member in its closed position and FIG. 13B showing the blocking member in its open position.

As best seen in FIGS. 11 and 13A, the surface of the blocking member 124 facing the neutral and live receptacles, 54 and 82, respectively, is provided with a recess 138 into which extends the free end of the spring section 90. The spring section serves to bias the blocking member 124 in one direction, to the left as shown in FIGS. 10 and 11.

Returning to FIGS. 8 and 9, it will be seen that the ground prong 16 passes through a slot 140, provided in the front wall of upper section 12A, and is integral with a U-shaped ground receptacle 142, which is accommodated within the chamber 56' formed in the upper section 12A of the housing. A tongue 143 is provided on the lower section 12B of the housing 12 and extends into the slot 140 when the complete housing is assembled, thus holding the ground prong 16 in its correct position. As may been seen from FIGS. 8 and 8, the chamber 56' also accommodates part of the fuse 110. The upper section 12A is molded to form two locating blocks 144 which retain the ground receptacle 142 in position. The ground receptacle 142 lies adjacent the ground aperture 34 in the upper section 12A so that the ground prong of an appliance plug can pass through the ground aperture 34 and contact the ground receptacle 142. (The blocking member 124 does not extend upwardly as far as the ground aperture 34, and thus, the ground aperture 34 remains open regardless of the position of the blocking member 124 within the chamber 116. Accordingly, the safety connector fuse 10 may be used with either a two-pin plug or a three-pin appliance plug, since in the latter case the neutral prong of the appliance plug simply enters the aperture 34 and contacts the ground receptacle 142.)

Figure 13B:
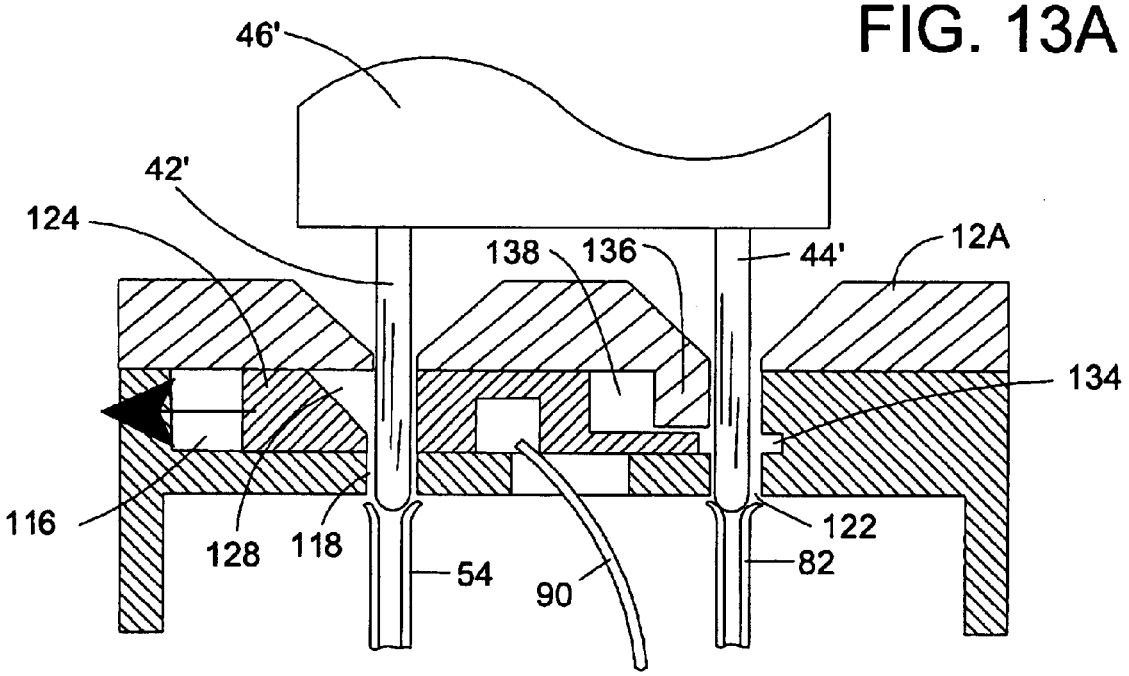

The operation of the blocking member 124 will now be described in detail with reference to FIGS. 10, 13A and 13B. As shown in FIGS. 10 and 13A, the placement of the neutral aperture 126 and the section 130 of the blocking member 124 is such that when no plug is inserted into the neutral and live apertures 36 and 38, the spring section 90 pushes the blocking member 124 to a closed position (to the left in FIG. 10 and to the right in FIG. 13A), in which the neutral aperture 126 is not aligned with the neutral aperture 36 in housing 12. In this position, the blocking member 124 blocks the neutral aperture 36, with only a portion of the cam surface 128 remote from the neutral aperture 126 lying adjacent the neutral aperture 36. Also in this position, section 130 of the blocking member 124 blocks the live aperture 38 in the housing, with the free edge of the section 130 remaining within the recess 134 in the housing 12. Thus, in this closed position, the blocking member 124 blocks both the neutral and live apertures, 36 and 38, in the housing. Furthermore, as best seen in FIG. 13A, the relative positions of the blocking member 124 on the one hand, and the recess 132 and projection 136 on the other, render it very difficult if not impossible to insert an object into the live aperture 38 in the housing 12 and move the blocking member 124 from its closed position, thus gaining access to the live receptacle 82. Since the end of section 130 of the blocking member 124 is received within the recess 134, one cannot move the blocking member 124 by pushing a screwdriver or similar device past the edge of the blocking member. In addition, the presence of the projection 136 prevents a user moving the blocking member 124 by pushing an object into the live aperture 38 at an inclined angle and pushing on the "step" where the section 130 of the blocking member is joined to the remainder of this member.

When the plug 46' is inserted into the connector fuse 10 in the direction of arrow A in FIG. 13A, the interaction between the tip of the neutral prong 42' of the plug and the cam surface 128 on the blocking member 124 causes the blocking member 124 to move against the bias of the spring section 90 in the direction of arrow B in FIG. 13A. As the plug 46' moves in the direction of arrow A, the Up of the live prong 44' enters into, and is accommodated within, the recess 132 adjacent section 130 of the blocking member 124. Thus, the presence of recess 132 allows the outlet of the present invention to be used with a plug 46' having neutral and live prongs 42' and 44' of equal length without contact between the live prong 44' and the blocking member 124 interfering with the normal insertion of the plug into the connector. Eventually, the blocking member 124 moves to an open position, as shown in FIG. 13B, allowing the neutral prong 42' to pass through the apertures 36, 126 and 118 into the neutral receptacle 54, while the live prong 44' passes through the aperture 38, past the end of the blocking member 124 and through the aperture 122 into the live receptacle 82. (Although not shown in FIGS. 13A and 13B, if a three-pin plug is used, the ground prong 48, of course, simultaneously passes through the aperture 34 (FIG. 9) into the ground receptacle 142.) As the plug 46' is withdrawn from the connector fuse 10, the movements of the various parts are reversed, and the spring section 90 restores the blocking member 124 to its closed position shown in FIG. 13A. Preferably, the spring constant is chosen so that blocking member 124 closes with an audible "snap" to indicate closure.

The connector fuses 10 and 10' described above are effective in achieving the objects of the present invention and are very suitable for general use, where it is desirable to be able to remove and replace connectors fuses easily in order to use different connector fuses with different appliances. However, in certain circumstances, for example in houses where very young children are present, or in nursing homes or hospitals occupied by people who may not be in full possession of their faculties, it may be desirable to modify the connector fuses so that they cannot readily be removed from the sockets into which they are inserted, thus preventing an unprotected electrical socket being exposed, and FIGS. 14–17 illustrate connector fuses of this type.

Figure 14:
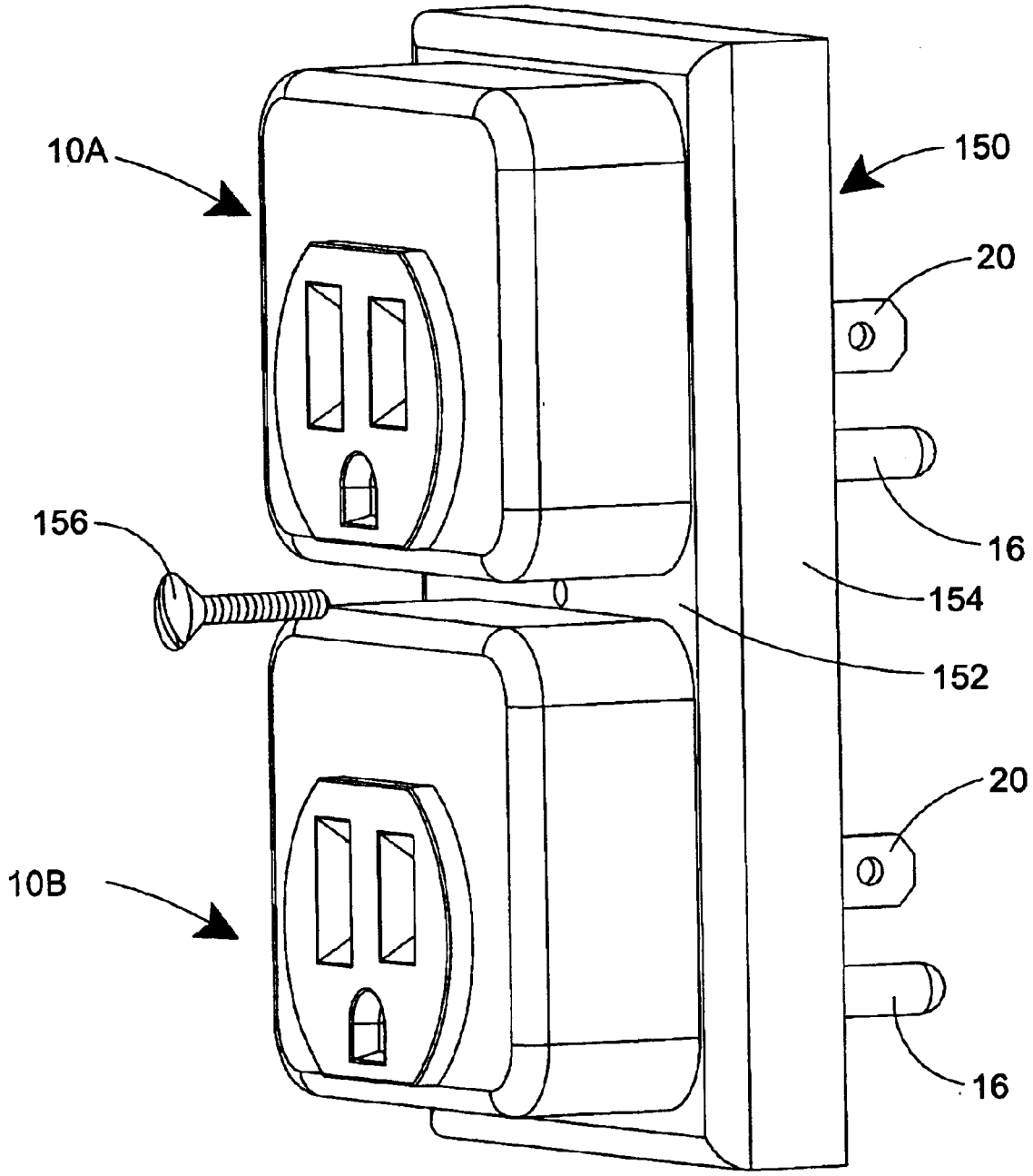
FIG. 14 shows a double connector fuse of the present invention provided with securing means by which it may be releasably secured to a double electrical outlet in place of the conventional face plate.

FIG. 14 illustrates a double safety connector fuse (generally designated 150) which essentially comprises two connector fuses 10A and 10B, each of which is identical to the connector fuse 10 previously described, except that the housings of the connector fuses 10A and 10B are integral with a plate 152, from the periphery of which extends, in the same direction as the prongs of the fuses 10A and 10B, a flange 154.

The safety connector fuse 150 is intended for use with a conventional double electrical outlet of the type found in homes and offices. Such an outlet has three main sections, the first of which is a box, which is secured to a wall stud or other fixed part of a building. The box has substantially the form of a hollow cuboid with its front face (which is flush with the surface of the surrounding wall) removed and with an aperture through which an electrical cable is passed into the box. The outlet also comprises an insert, which comprises the electrical sockets themselves and terminals for the conductors within the cable, this insert normally being secured within the box by screws which pass through apertures on the insert into threaded sockets provided on the top and bottom edges of the box. Finally, the outlet comprises a face plate which covers the openings between the periphery of the insert and the edges of the box and contacts the wall surface surrounding the box, this face plate normally being held in position by a single screw which passes through an aperture in the center of the face plate, between the two electrical outlets, and into a threaded socket provided in the center of the insert.

The safety connector fuse 150 is used in place of the conventional face plate. The face plate and its associated screw 156 are first removed from the outlet, and the prongs of the fuse 150 are inserted into the two electrical sockets. The screw 156 is then reinstalled, thus securing the fuse 150 in position and preventing manual removal thereof. The dimensions of the fuse 150 are arranged so that once the screw 156 has been tightened, the free edge of the flange 154 is in contact with the wall surface surrounding the box, thus fulfilling the same function as the conventional face plate.

Figure 15:
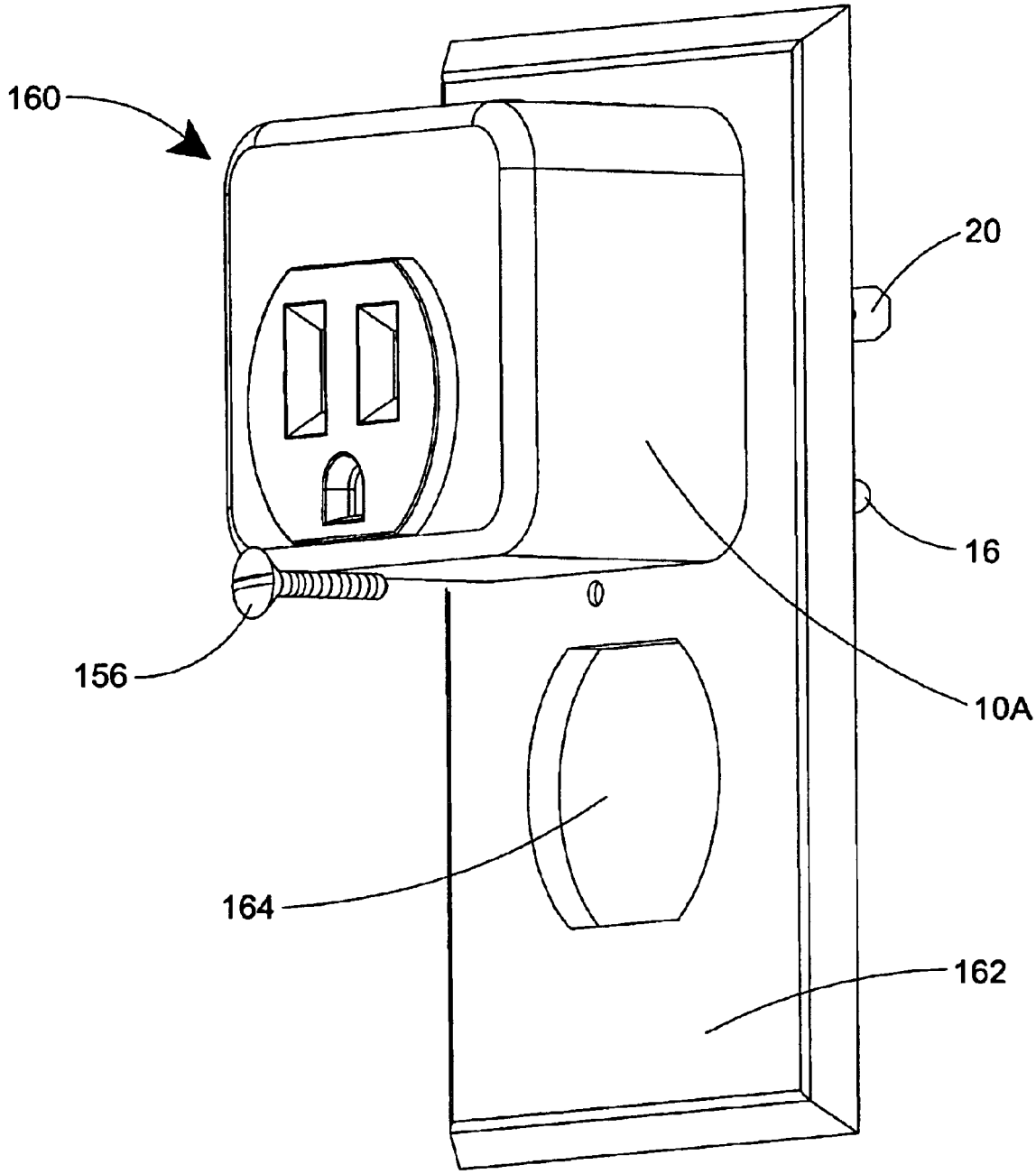
FIG. 15 shows a single connector fuse of the present invention provided with securing means by which it may be releasably secured to a double electrical outlet in place of the conventional face plate.

FIG. 15 illustrates a further safety connector fuse (generally designated 160) which is generally similar to the connector fuse 150 shown in FIG. 14. However, the connector fuse 160 provides only a single safety connector fuse 10A, and has a flange 162 having an aperture 164 passing therethrough. This aperture 164 provides access to the lower socket of the outlet; when the fuse 160 is installed in the same manner as the fuse 150, namely, by removing the conventional face plate and associated screw 156, inserting the prongs of the fuse 150 into the upper socket, and replacing the screw 156.

Figure 16:
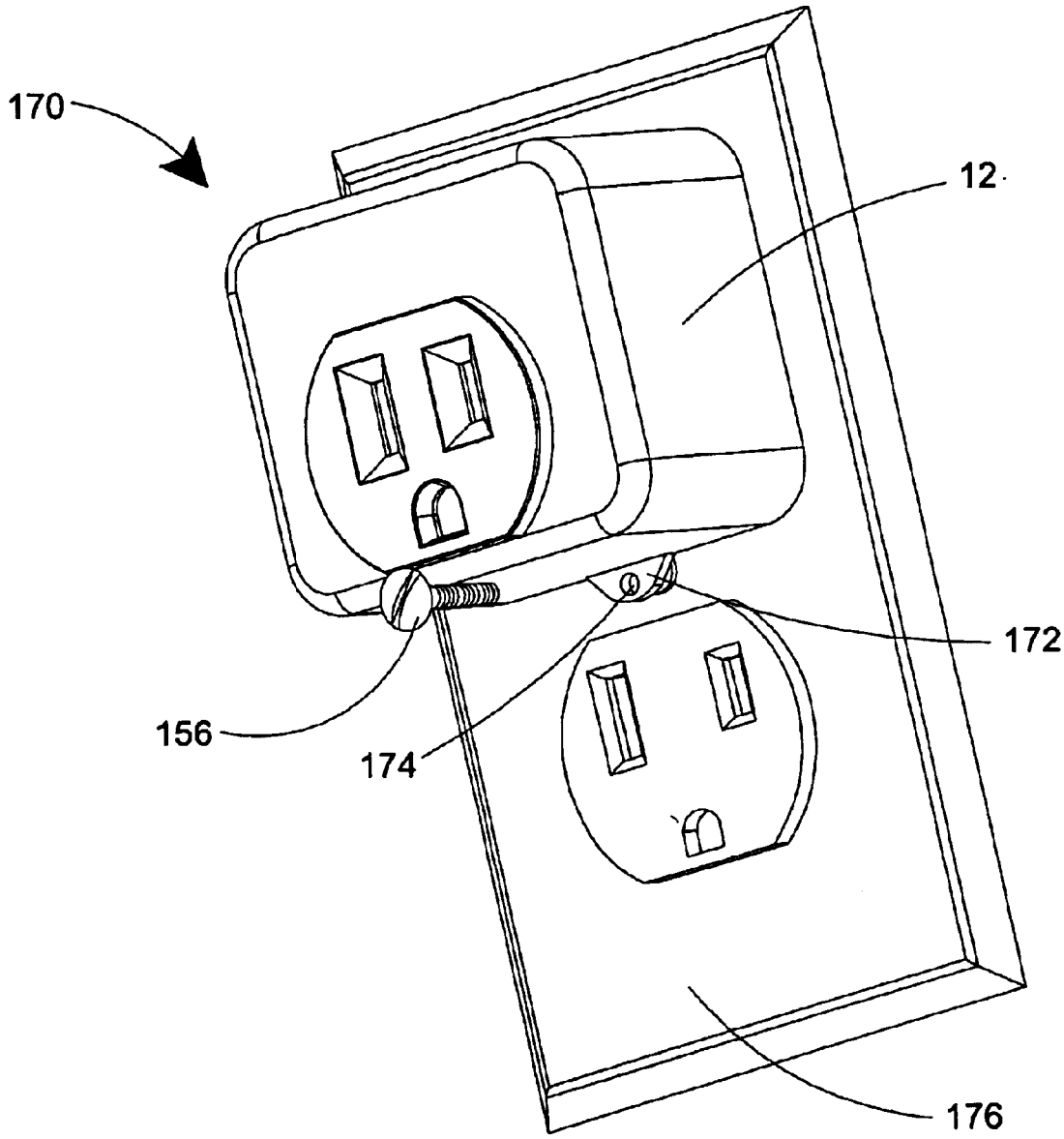
FIG. 16 shows a single connector fuse of the present invention provided with securing means by which it may be releasably secured to a double electrical outlet without removal of the conventional face plate.

FIG. 16 shows a further safety connector fuse (generally designated 170) of the present invention. This fuse 170 is essentially a modified version of the connector fuse 10 described above which can be secured to an electrical outlet to prevent manual removal of the connector use. For this purpose, a lug 172 is provided on the lower surface of the housing 12, this lug 172 having an aperture 174 extending therethrough. The dimensions of the lug 172 are arranged so that when the fuse 170 is inserted into the upper socket of a double outlet, the aperture 174 overlies the central socket into which the screw 156 is inserted to secure the face plate 176 of the outlet. The socket 170 is secured to the outlet by first removing the screw 156 (but not the face plate 176), inserting the socket 170 into the upper socket of the outlet, and reinserting the screw 156.

Figure 17:
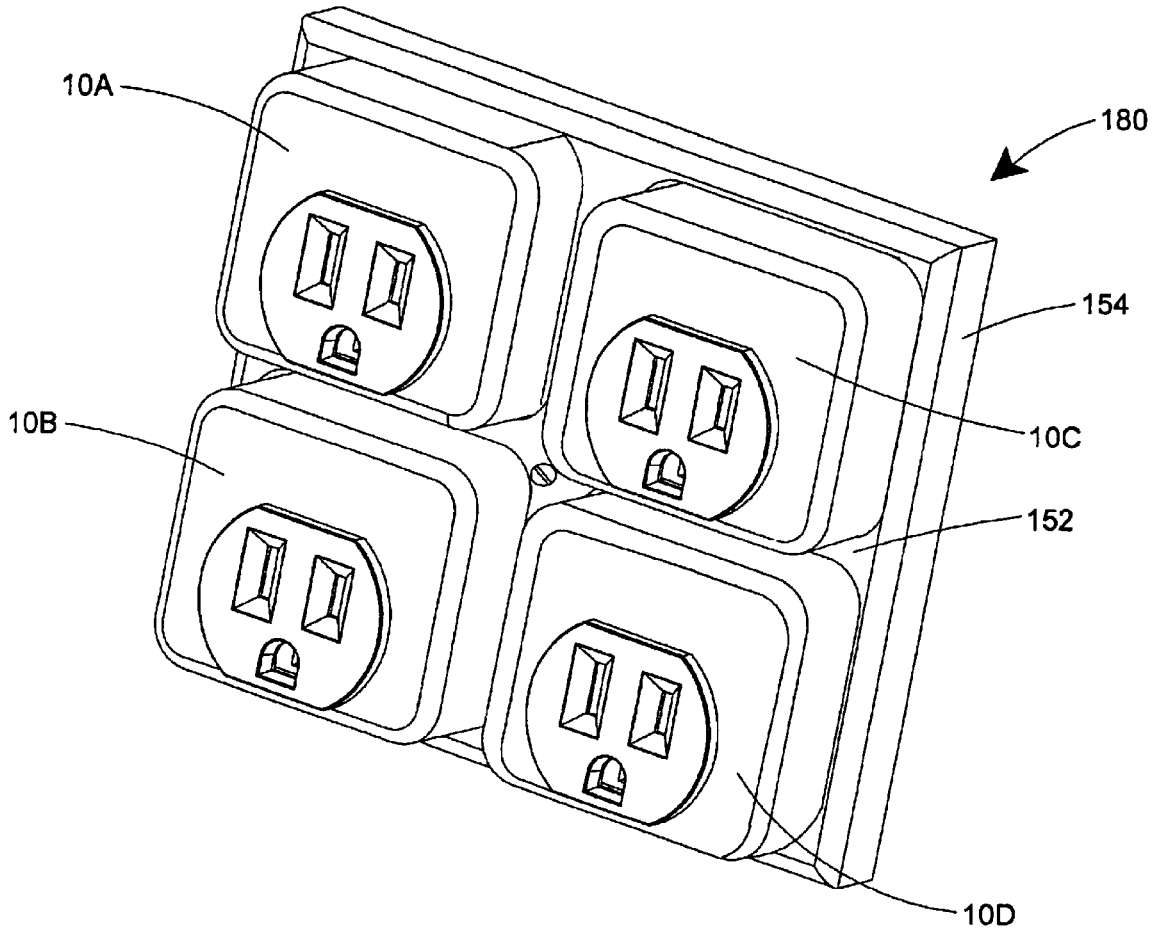
FIGS. 17 shows a quadruple connector fuse of the, present invention provided with securing means by which it may be releasably secured to a quadruple electrical outlet in place of the conventional face plate.

FIG. 17 illustrates a quadruple safety connector fuse (generally designated 180) of the present invention which is very similar to the connector fuse 150 shown in FIG. 14 but which has two additional connector fuses 10C and 10D. The fuse 180 has a plate 152 and a flange 154 which are identical, apart from dimensions, to the corresponding parts of the fuse 150. The fuse 180 is secured to an electrical outlet in the same manner as the fuse 150.

The fuse 180 is intended for use with a quadruple electrical outlet, and is consequently provided with four set of prongs (not shown in FIG. 18). However, if desired the fuse 180 could be adapted for use with a double electrical outlet by being provided with only two sets of prongs and appropriate internal conductors to connect these two set of prongs to the four sets of receptacles adjacent the four sockets of the device.

Figure 18A:
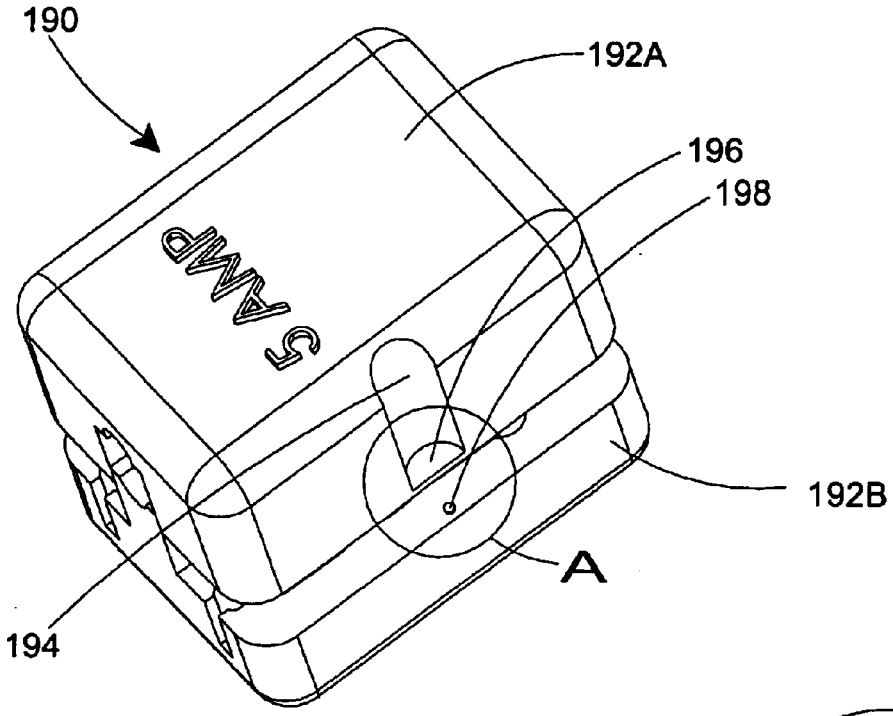
FIGS. 18A and 18B show modifications which may be made in the housing of the connector fuse shown in FIGS. 1, 3, 5 and 8–13 to facilitate manufacture of the housing.
Figure 18B:
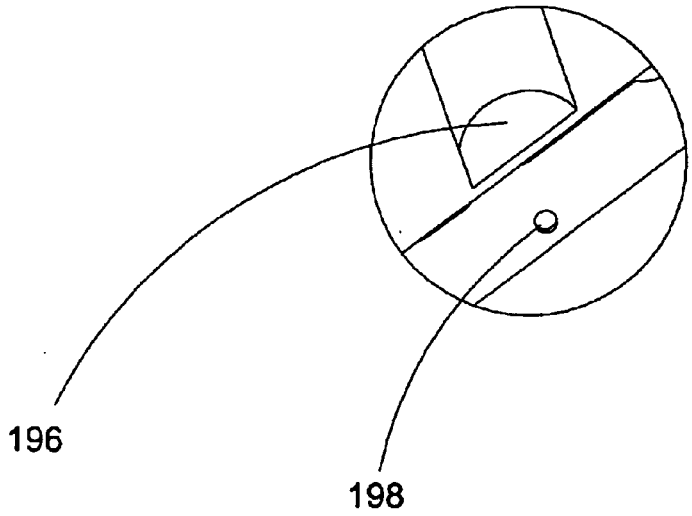
Figure 19:
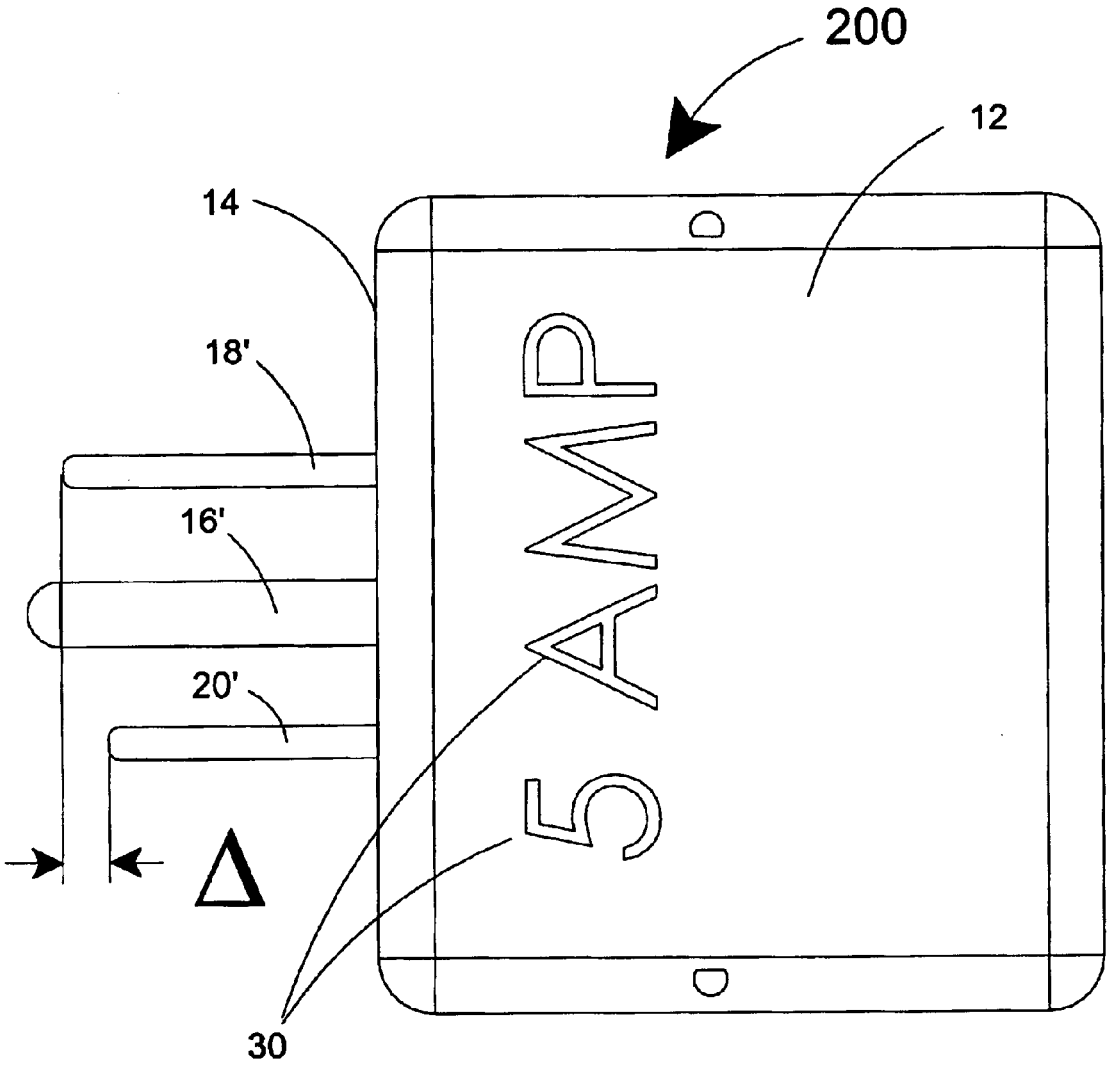
FIG. 19 is a top plan view of a connector fuse of the present invention in which the neutral prong extends further from the housing than does the liver prong.

FIGS. 18A and 18B illustrate modifications which may be made to the housing of a safety connector fuse of the present invention to facilitate ultrasonic welding of the two halves of the housing. FIGS. 18A and 18B show a connector fuse 190 generally similar to the connector fuse 10 previously described, the prongs of this fuse being omitted for ease of illustration. The fuse 190 has a housing formed from an upper section 192A and a lower section 192B, which are secured together to form the final housing by ultrasonic welding. To facilitate such welding, the upper section 192A is provided, on one of its side surfaces, with a hemicylindrical recess 194, which terminates just short of the lower end of the upper section 192A, thus leaving a thin plate 196 at the lower end of the upper section 192A. The lower section 192B is provided at its upper end with a small projection 198 located so that, when the upper and lower sections 192A and 192B are aligned correctly to form the final housing, the projection 198 lies adjacent the thin plate 196. The plate 196 and projection 198 concentrate ultrasonic energy and thus facilitate ultrasonic welding of the two sections of the housing, Finally, FIG. 19 shows a connector fuse (generally designated 200) which is generally similar to the connector fuse 10 previously described but which has a neutral prong 18' which projects from the front face 14 of the housing 12 by a greater distance than the live prong 20', while the ground prong 20' projects by a greater distance than the neutral prong 18'. The difference Δ between the projections of the live and neutral prongs is desirably at least about 1 mm to assure minimum spacing between the front face 14 and socket 28 (FIG. 1) at the time the live prong 20' makes electrical contact. The reduces the possibility for physical contact of a user with the live prong 20' at the time of being powered up because this prong is relatively less accessible than it otherwise would be if longer.

It will readily be apparent to those skilled in the art that numerous changes and modifications can be made to the preferred embodiments of the invention described above without departing from the scope of the invention. For example, it is not necessary that the whole housing of the connector fuse be transparent; a limited transparent, or even translucent, area on the housing will suffice provided light emitted from the light emitting means is visible from outside the housing. Also, although the preferred embodiments of the invention illustrated in the accompanying drawings use a resistor in series with the light emitting means, such a resistor may not be necessary with certain types of lamp or other light emitting means. Furthermore, in applications where, because of the position of the safety connector use, it might be difficult to read the markings thereon, the color of the light emitted might be varied to indicate the rating of the fuse. Moreover, although all the illustrated embodiments are three-pin, having three prongs for insertion into a socket and three apertures for receiving a three-pin appliance plug, it will readily be seen that the ground prong, the ground aperture and the ground receptacle could be omitted to provide a two-pin connector fuse. Therefore, it is intended that the embodiments described herein be considered as illustrative and not be construed in a limiting sense.

From the foregoing it will be seen that the present invention provides a safety connector fuse which offers a high level of safety in that the user can be assured as to the rating of the fuse in the plug, thus enabling the user to choose a plug of the correct rating for any intended application. The connector fuse of the invention can provide a visual indication when its fuse has blown and a high degree of protection against fires due to overloading and shorts and electric shocks caused by objects being accidentally inserted into the connector. It will be appreciated that the connector fuse may also beneficially be used as a night light to provide guidance throughout structures when their principal lighting has been turned off for the night.

What is claimed is:

1. An electrical safety connector fuse for insertion into an electrical socket having at least live and neutral prong receptacles, the connector fuse comprising:

a sealed, tamper-proof housing having live and neutral apertures arranged to receive the live and neutral prongs respectively of an electrical plug, substantially the whole of said housing being light-transmissive;

a means for emitting light disposed within said housing so that light emitted from said means for emitting light is electrically connected to said live and neutral receptacles of said connector fuse so as to emit light when a potential difference exists between said receptacles;

live and neutral prongs extending outwardly from said housing at points spaced from said live and neutral apertures, said live and neutral prongs being arranged to engage the live and neutral prong receptacles respectively of said electrical socket said live and neutral prongs being arranged to engage the live and neutral prong receptacles, respectively, of said electrical socket, said live prong of said connector fuse having an outward surface facing away from said neutral prong thereof, at least a portion of said outward surface being formed from an electrically insulating material;

a fuse disposed within said housing and electrically connected to said live prong;

a live receptacle electrically connected to said fuse, and disposed within said housing adjacent said live aperture therein so as to engage the live prong of an appliance plug passing through said live aperture;

a neutral receptacle electrically connected to said neutral prong, and disposed within said housing adjacent said neutral aperture therein so as to engage the neutral prong of an appliance plug passing through said neutral aperture; and a blocking member disposed within said housing adjacent said live and neutral apertures therein, said blocking member having a neutral aperture extending therethrough, said blocking member being biased in a closed position and movable in response to the insertion of a plug prong into said neutral aperture been said dosed position, in which it blocks the live and neutral apertures in said housing, and an open position in which the neutral aperture of said blocking member is aligned with the neutral aperture of said housing and said blocking member does not block the live aperture of said housing, thereby allowing said live and neutral prongs of said appliance plug to pass through said live and neutral apertures in said housing and engage said live and neutral receptacles within said housing.

2. A connector fuse according to claim 1 for insertion into an electrical socket having a ground aperture and a ground prong receptacle, wherein said housing of said connector fuse has a ground aperture adjacent said live and neutral apertures and arranged to receive the ground prong of said appliance plug, said connector fuse further comprising:

a ground prong extending outwardly from said housing adjacent said live and neutral prongs on said housing and arranged to engage the ground prong receptacle of said electrical socket; and a ground receptacle electrically connected to said ground prong, and disposed within said housing adjacent said ground aperture therein so as to engage the ground prong of a plug passing through said ground aperture.

3. A connector fuse according to claim 1 wherein said housing bears at least one marking indicating the rating of said fuse.

4. A connector fuse according to claim 3 wherein said at least one marking is at least in part in Braille.

5. A connector fuse according to claim 1 further comprising means for releasably securing said connector fuse to said electrical socket.

6. A connector fuse according to claim 5 wherein said securing means comprises a flange extending laterally from said tamper-proof housing, said flange having at least one aperture extending therethrough such that a fastener can be inserted through said aperture to secure said connector fuse to said electrical socket.

7. A connector fuse according to claim 6 wherein said flange is adapted to replace the face plate of a conventional electrical socket.

8. A connector fuse according to claim 1 further comprising a resistor connected in series with said light emitting means between said live and neutral recess in said housing.

9. A connector fuse according to claim 1 wherein said light emitting means is selected from the group comprising an incandescent bulb, a light emitting diode, and an electroluminescent device.

10. An electrical safety connector fuse for insertion into an electrical socket having at least live and neutral prong receptacles, the connector fuse comprising:

a sealed, tamper-proof housing having live and neutral apertures arranged to receive the live and neutral prongs respectively of an electrical plug;

live and neutral prongs extending outwardly from said housing at points spaced from said live and neutral apertures, said live and neutral prongs being arranged to engage the live and neutral prong receptacles respectively of said electrical socket;

a fuse disposed within said housing and electrically connected to said live prong;

a live receptacle electrically connected to said fuse, and disposed within said housing adjacent said live aperture therein so as to engage the live prong of an appliance plug passing through said live aperture;

a neutral receptacle electrically connected to said neutral prong, and disposed within said housing adjacent said neutral aperture therein so as to engage the neutral prong of an appliance plug passing through said neutral aperture; and a blocking member disposed within said housing adjacent said live and neutral apertures therein, said blocking member having a neutral aperture extending therethrough, said blocking member being movable between a closed position, in which it blocks the live and neutral apertures in said housing, and an open position in which the neutral aperture of said blocking member is aligned with the neutral aperture of said housing, and said blocking member does not block the live aperture of said housing, thereby allowing said live and neutral prongs of said appliance plug to pass through said live and neutral apertures in said housing and engage said live and neutral receptacles within said housing, said blocking member being provided with biasing means for biasing said blocking member towards its closed position, said blocking member also having a cam surface disposed adjacent its neutral aperture and arranged to be engaged by said neutral prong of said appliance plug passing through said neutral aperture in said housing, so that contact between said neutral prong and said cam surface causes said blocking member to move to its open position.

11. A connector fuse according to claim 10 wherein said housing is provided with a closed internal chamber configured to accommodate said blocking member while permitting said blocking member to slide within said chamber between its open and closed positions.

12. A connector fuse according to claim 11 wherein said biasing means comprises a spring one end of which is accommodated with a spring recess in said blocking member.

13. A connector fuse according to claim 12 wherein said spring is secured to, or integral with, one of said receptacles of said connector fuse.

14. A connector fuse according to claim 10 wherein said cam surface has the form of an inclined surface defining part of the periphery of said neutral aperture in said blocking member.

15. A connector fuse according to claim 14 wherein said blocking member has a recess arranged so that, when the blocking member is in it closed position, the recess lies adjacent said live aperture of said connector fuse, so that a portion of said live prong of said appliance plug can be accommodated within said recess while said blocking member is still in its closed position.

16. A connector fuse according to claim 15 wherein said recess in said blocking member extends to a free edge of said blocking member such that, when sold blocking member is in its open position, said live prong of said appliance plug will pass beyond said free edge of said blocking member.

17. A connector fuse according to claim 16 wherein said housing is provided with a recess arranged to receive said free edge of said blocking member when said blocking member is in its closed position.

18. A connector fuse according to claim 15 wherein said housing carries a projection extending away from an inner surface of said housing adjacent said live aperture therein and into said recess in said blocking member, said projection serving to hinder access to a wall of said recess by an object inserted through said live aperture in said housing.

19. An electrical safety connector fuse for insertion into an electrical socket having at least live and neutral prong receptacles, the connector fuse comprising:

a sealed, tamper-proof housing having live and neutral apertures arranged to receive the live and neutral prongs respectively of an electrical plug;

live and neutral prongs extending outwardly from said housing at points spaced from said live and neutral apertures, said live and neutral prongs being arranged to engage the live and neutral prong receptacles respectively of said electrical socket, said neutral prong of said connector fuse extending a greater distance from said housing than said live prong of said connector fuse;

a fuse disposed within said housing and electrically connected to said live prong;

a live receptacle electrically connected to said fuse, and disposed within said housing adjacent said live aperture therein so as to engage the live prong of an appliance plug passing through said live aperture; and a neutral receptacle electrically connected to said neutral prong, and disposed within said housing adjacent said neutral aperture therein so as to engage the neutral prong of an appliance plug passing through said neutral aperture.

20. A connector fuse according to claim 19 wherein said neutral prong of said connector fuse extends at least about 1 mm further from said housing than said live prong of said connector fuse.

21. An electrical safety connector fuse for insertion into an electrical socket having at least live and neutral prong receptacles, the connector fuse comprising:

a sealed, tamper-proof housing having live and neutral apertures arranged to receive the live and neutral prongs respectively of an electrical plug;

live and neutral prongs extending outwardly from said housing at points spaced from said live and neutral apertures, said live and neutral prongs being arranged to engage the live and neutral prong receptacles respectively of said electrical socket, said live prong of said connector fuse having a outward surface facing away from said neutral prong thereof, at least a portion of said outward surface being formed from an electrically insulating material wherein a tip portion of said outward surface remote from said housing is from said insulating material, a root section of said outward surface adjacent said housing being formed from an electrically conducting material;

a fuse disposed within said housing and electrically connected to said live prong;

a live receptacle electrically connected to said fuse, and disposed within said housing adjacent said live aperture therein so as to engage the live prong of an appliance plug passing through said live aperture; and a neutral receptacle electrically connected to said neutral prong, and disposed within said housing adjacent said neutral aperture therein so as to engage the neutral prong of an appliance plug passing through said neutral aperture.

22. A connector fuse according to claim 21 wherein the outward surfaces of said insulating material and said conducting material are substantially flat and coplanar.

23. A connector fuse according to claim 21 wherein said neutral prong of said connector fuse also has an inward surface facing said live prong thereof, a tip portion of said inward surface remote from said housing also being formed from said insulating material.

24. A connector fuse according to claim 21 wherein substantially the whole of said outward surface is formed from said insulating material.

25. A connector fuse according to claim 21 wherein said neutral prong of said connector fuse has a outward surface facing away from said live prong thereof, at least a portion of said outward surface of said neutral prong also being formed from an electrically insulating material.

26. An electrical safety connector fuse for insertion into an electrical socket having at least live and neutral prong receptacles, the connector fuse comprising:

a sealed, tamper-proof housing having live and neutral apertures arranged to receive the live and neutral prongs respectively of an electrical plug;

live and neutral prongs extending outwardly from said housing at points spaced from live and neutral apertures, said live and neutral prongs being arranged to engage the live and neutral prong receptacles respectively of said electrical socket;

a fuse dispose within said housing and electrically connected to said live prong:

a live receptacle electric connected to said fuse, and disposed within said housing adjacent said live aperture therein so as to engage the live prong of an appliance plug passing through said live aperture;

a neutral receptacle electrically connected to said neutral prong, and disposed within said housing adjacent said neutral aperture therein so as to engage the neutral prong of an appliance plug passing through said neutral aperture; and a blocking member disposed within said housing adjacent said live and neutral apertures therein, said blocking member having a neutral aperture extending therethrough, said blocking member being movable between a closed position, in which it blocks the live and neutral apertures in said housing, and an open position in which the neutral aperture of said blocking member is aligned with the neutral aperture of said housing, and said blocking member does not block the live aperture of said housing, thereby allowing said live and neutral prongs of said appliance plug to pass through said live and neutral apertures in said housing and engage said live and neutral receptacle within said housing, said blocking member being provided with biasing means for biasing said blocking member towards its closed position, said blocking member also having a cam surface disposed adjacent its neutral aperture and arranged to be engaged by said neutral prong of said appliance plug passing through said neutral aperture in said housing, so that contact between said neutral prong and said cam surface causes said blocking member to move to its open position.

* * * * *